US010641268B2

(12) United States Patent
Brostrom et al.

(10) Patent No.: US 10,641,268 B2
(45) Date of Patent: May 5, 2020

(54) MULTIPLE COMPRESSOR CONFIGURATION WITH OIL-BALANCING SYSTEM

(71) Applicant: Emerson Climate Technologies, Inc., Sidney, OH (US)

(72) Inventors: Troy Richard Brostrom, Lima, OH (US); Adam J. D'Amico, Sidney, OH (US); Jacob A. Groshek, Sidney, OH (US); Reema Kamat, Sidney, OH (US); Douglas P. Pelsor, Dublin, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 390 days.

(21) Appl. No.: 15/232,094

(22) Filed: Aug. 9, 2016

(65) Prior Publication Data

US 2017/0045052 A1 Feb. 16, 2017

Related U.S. Application Data

(60) Provisional application No. 62/203,864, filed on Aug. 11, 2015.

(51) Int. Cl.
*F04C 28/02* (2006.01)
*F04C 29/02* (2006.01)
(Continued)

(52) U.S. Cl.
CPC ..... *F04C 29/021* (2013.01); *F04C 23/001* (2013.01); *F04C 23/008* (2013.01);
(Continued)

(58) Field of Classification Search
CPC .... F04C 29/021; F04C 29/028; F04C 23/008; F04C 23/001; F04C 2270/86;
(Continued)

(56) References Cited

U.S. PATENT DOCUMENTS 4,383,802 A * 5/1983 Gianni ..... F01M 11/12 417/12
4,990,057 A * 2/1991 Rollins ..... F04D 27/0292 417/12

(Continued)

FOREIGN PATENT DOCUMENTS

CN 102200360 A 9/2011
CN 103206359 A 7/2013

(Continued)

OTHER PUBLICATIONS

International Search Report regarding International Application No. PCT/US2016/046386, dated Nov. 17, 2016.

(Continued)

*Primary Examiner* — Devon C Kramer
*Assistant Examiner* — Stephen A Mick
(74) *Attorney, Agent, or Firm* — Harness, Dickey & Pierce, P.L.C.

(57) ABSTRACT

An oil balancing system for a multiple compressor system is provided. The oil balancing system includes an oil equalization line disposed between a first compressor and a second compressor. A first solenoid valve is provided in the oil equalization line. A first signal corresponds to a first oil level in the first compressor. A second signal corresponds to a second oil level in the second compressor. An oil balancing module uses the first signal and the second signal to diagnose an oil imbalance between the first compressor and the second compressor, and applies corrective action, whereby the corrective action includes sending control signals to operate at least one of the first compressor, the second compressor, or the first solenoid valve in a way that eliminates the oil imbalance.

11 Claims, 7 Drawing Sheets

(51) Int. Cl.
*F25B 31/00* (2006.01)
*F04C 23/00* (2006.01)
*F04C 18/02* (2006.01)

(52) U.S. Cl.
CPC ..... *F04C 29/028* (2013.01); *F25B 31/004* (2013.01); *F04C 18/0215* (2013.01); *F04C 28/02* (2013.01); *F04C 2240/70* (2013.01); *F04C 2240/806* (2013.01); *F04C 2240/809* (2013.01); *F04C 2270/24* (2013.01); *F04C 2270/70* (2013.01); *F04C 2270/86* (2013.01); *F25B 2400/075* (2013.01); *F25B 2600/025* (2013.01)

(58) Field of Classification Search
CPC ..... F04C 2270/70; F04C 2240/809; F04C 2240/806; F04C 2240/70; F04C 18/0215; F04C 28/02; F04C 23/00; F25B 31/004; F25B 2400/075; F25B 2600/025; F25B 31/02; F04B 41/06
USPC ..... 417/228
See application file for complete search history.

(56) References Cited

U.S. PATENT DOCUMENTS

| | | | | |
|---|---|---|---|---|
| 5,586,450 | A | 12/1996 | Tollar et al. | |
| 5,634,345 | A | 6/1997 | Alsenz | |
| 5,765,994 | A * | 6/1998 | Barbier | F04B 39/0207 250/577 |
| 7,137,265 | B2 | 11/2006 | Kim | |
| 7,222,491 | B2 | 5/2007 | Moriwaki | |
| 8,312,732 | B2 | 11/2012 | Sakitani et al. | |
| 2009/0314017 | A1 * | 12/2009 | Nishimura | F25B 49/005 62/149 |
| 2010/0206000 | A1 | 8/2010 | Jeong et al. | |
| 2011/0138831 | A1 | 6/2011 | Ogata et al. | |
| 2011/0239667 | A1 | 10/2011 | Won et al. | |
| 2013/0136622 | A1 * | 5/2013 | De Bernardi | F04D 29/063 417/13 |
| 2013/0177404 | A1 | 7/2013 | Bernardi et al. | |
| 2014/0037483 | A1 | 2/2014 | Fraser et al. | |
| 2014/0037484 | A1 | 2/2014 | Fraser et al. | |
| 2014/0056725 | A1 | 2/2014 | Fraser et al. | |
| 2014/0056727 | A1 * | 2/2014 | Koyama | F04C 18/0215 417/228 |
| 2014/0326008 | A1 | 11/2014 | Yoon et al. | |
| 2015/0114013 | A1 | 4/2015 | Joo et al. | |

FOREIGN PATENT DOCUMENTS

| | | | |
|---|---|---|---|
| EP | 1367259 | A1 | 12/2003 |
| EP | 1703231 | B1 | 5/2010 |
| EP | 2375193 | A2 | 10/2011 |
| EP | 2801769 | A1 | 11/2014 |
| EP | 2853742 | A1 | 4/2015 |
| JP | H0317469 | A | 1/1991 |
| JP | H07103593 | A | 4/1995 |
| JP | 2001349644 | A | 12/2001 |
| KR | 20040092213 | A | 11/2004 |
| WO | 2010122812 | A1 | 10/2010 |

OTHER PUBLICATIONS

Written Opinion of the International Searching Authority regarding International Application No. PCT/US2016/046386, dated Nov. 17, 2016.
European Search Report dated Mar. 4, 2019 (corresponding to EP 16835854.7).
Chinese Office Action dated Sep. 27, 2018 with English translation (corresponding to CN201680047452.2).

* cited by examiner

MULTIPLE COMPRESSOR CONFIGURATION WITH OIL-BALANCING SYSTEM

CROSS-REFERENCE TO RELATED APPLICATIONS

This application claims the benefit of U.S. Provisional Application No. 62/203,864, filed on Aug. 11, 2015, the entire disclosure of which is incorporated herein by reference.

FIELD

The present disclosure relates to multiple compressor configurations, and more particularly to systems and methods for balancing lubricant oil between/among the compressors.

BACKGROUND

This section provides background information related to the present disclosure which is not necessarily prior art.

Compressors are used in a plurality of technical areas in industrial environments as well as domestic environments, mainly for increasing the pressure of a gas or liquid. Compressors may be used in a multiple configuration, in which two (2) or more compressors operate in parallel. A tandem or other multiple (3, 4, 5, etc.) compressor system may be operated in a single compressor state, with a subset or with all compressors, thereby providing a wide range of capacity.

Compressors must provide steady performance during operation time. Compressors operating in a tandem configuration often run into the challenge of balancing oil levels between them. If the oil level in one of the compressors were to get too low, adverse effects (e.g. oil starvation) may manifest themselves. Thus, it is important to constantly monitor the lubrication properties of the oil in the compressor to allow smooth operation of the compressor. Historically, a carefully designed and calibrated orifice in the suction manifold has been used to achieve a desired pressure differential for fluid in flow in order to balance the oil levels.

SUMMARY

This section provides a general summary of the disclosure, and is not a comprehensive disclosure of its full scope or all of its features.

An oil balancing system for a tandem compressor system is provided. The oil balancing system comprises: an oil equalization line disposed between a first compressor and a second compressor; a first valve in the oil equalization line; and an oil balancing module that receives a first signal corresponding to a first oil level in the first compressor and a second signal corresponding to a second oil level in the second compressor to diagnose an oil imbalance between the first compressor and the second compressor, and applies corrective action, whereby the corrective action comprises sending control signals to operate at least one of the first compressor, the second compressor, or the first solenoid valve in a way that reduces or eliminates the oil imbalance.

The oil balancing system may also use the first signal and the second signal to verify that the corrective action has reduced or eliminated the oil imbalance. In another form, the oil balancing system further comprises an oil sensing module that provides the first signal and the second signal. The oil sensing module uses the first signal to determine whether the first compressor operates in an acceptable mode or an unacceptable mode based on a predetermined unacceptable value for the first signal. The oil balancing module uses the second signal to determine whether the second compressor operates in an acceptable mode or an unacceptable mode based on a predetermined unacceptable value for the second signal. In still other forms, the oil sensing module of the oil balancing system uses the first signal to determine whether the first compressor operates in a warning mode based on a predetermined warning value for the first signal. The oil sensing module uses the second signal to determine whether the second compressor operates in a warning mode based on a predetermined warning value for the second signal.

In another embodiment, the oil balancing system further comprises a self-learning module configured to create a record of time spent in acceptable mode, warning mode, and unacceptable mode for each of the first compressor and the second compressor. The self-learning module alters the corrective action of the oil balancing module based on the record.

A first fault signal of the oil sensing module of the oil balancing system may be generated when the first compressor operates in unacceptable mode for a predetermined amount of time and/or a second fault signal may be generated when the second compressor operates in unacceptable mode for a predetermined amount of time. In one form, the oil balancing system further comprises a fault count module configured to increment a first fault count when a first fault signal is detected and to increment a second fault count when a second fault signal is detected. The oil balancing module further comprises a quarantine module configured to close the first solenoid valve when the first fault count or the second fault count exceeds a predetermined quarantine set point. In still other forms, the quarantine module is further configured to shut down the first compressor when the first fault count exceeds the quarantine set point and to shut down the second compressor when the second fault count exceeds the quarantine set point.

In another embodiment, the oil balancing system further comprises a leak detection module that uses the first signal and the second signal to determine whether an oil leak is present. In still another embodiment, the leak detection module uses a first discharge temperature of the first compressor and a second discharge temperature of a second compressor to determine whether the HVAC system also has a refrigerant leak. The oil balancing system can further alert the user of a probable location where the leak may be located.

In one form, the first compressor and the second compressor are scroll compressors.

In still other embodiments, the oil balancing system further comprises a third compressor. The oil equalization line further extends to the third compressor. The first solenoid valve is disposed at a location such that it is capable of isolating the first compressor from the second compressor and the third compressor. The oil balancing system further comprises a second solenoid valve on the oil equalization line. The second solenoid valve is at a location such that it is capable of isolating the second compressor from the first compressor and the third compressor. The oil balancing system further comprises a third solenoid valve on the oil equalization line. The third solenoid valve is at a location such that it is capable of isolating the third compressor from the first compressor and the second compressor. The oil balancing system further comprises a third signal that corresponds to a third oil level in the third compressor. The oil balancing module further uses the third digital signal to diagnose an oil imbalance, and applies corrective action. The corrective action may further comprise sending control signals to operate at least one of the third compressor, the second solenoid valve, or the third solenoid valve.

A method of balancing oil in a tandem compressor system is also provided. The method comprises using a first signal from a first compressor and a second signal from a second compressor to diagnose an oil imbalance between the first compressor and the second compressor. The method further comprises applying a corrective action. The corrective action comprises sending control signals to operate at least one of a solenoid valve on an oil equalization line between the first compressor and the second compressor, the first compressor, or the second compressor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
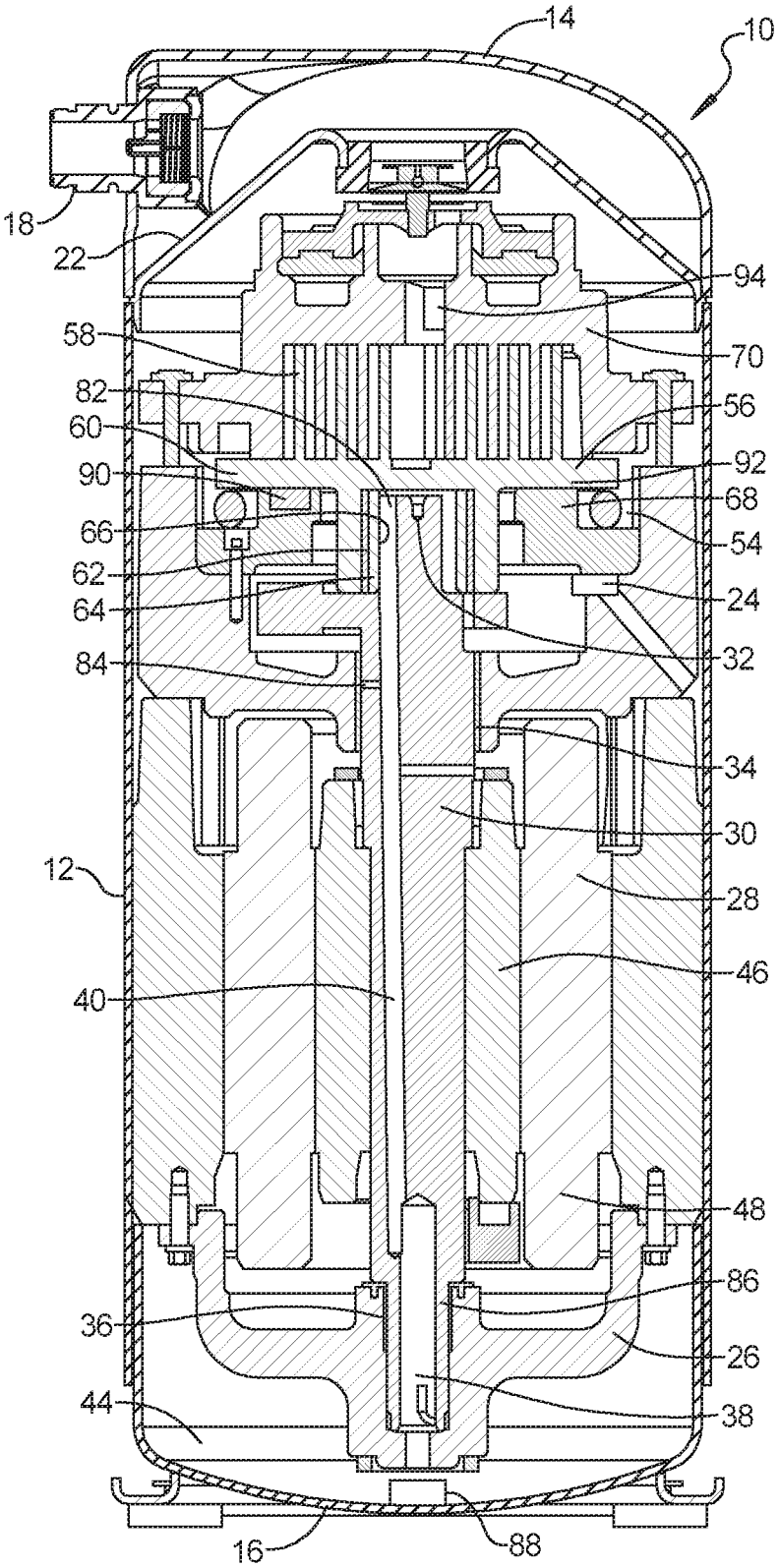
FIG. 1 is a cross sectional view of a scroll compressor with an oil sensing apparatus.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a cross-sectional view of a scroll compressor 10 with an oil sensing apparatus is provided. FIG. 1 merely provides background information on one type of compressor with one type of oil sensing module. It should be understood that the present disclosure is not limited to the embodiment disclosed in FIG. 1. Different types of compressors, such as rotary, rotating, orbiting, and reciprocating, may be used while remaining within the scope of this disclosure. Further, any method for determining oil level that provides a signal may be employed while remaining within the scope of the present disclosure.

Compressor 10 includes a generally cylindrical hermetic shell 12 having welded at the upper end thereof a cap 14 and at the lower end thereof a base 16 having a plurality of mounting feet integrally formed therewith. Cap 14 is provided with an outlet port 18. Other major elements affixed to the shell may include a transversely extending partition 22 which is welded about its periphery at the same point that cap 14 is welded to shell 12, a main bearing housing 24 which is suitably secured to shell 12 and a lower bearing housing 26 having a plurality of radially outwardly extending legs each of which is also suitably secured to shell 12. A motor stator 28 is provided in a fixed position within the hermetic shell.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. The lower portion of the interior of the shell 12 defines an oil sump 44 which is filled with lubricating oil to a predetermined level. The bore 38 in the crankshaft 30 acts as a pump to pump lubricating fluid up the crankshaft 30 and into bore 40 and ultimately to all of the various portions of the compressor which require lubrication.

Crankshaft 30 is rotatively driven by an electric motor including stator 28, windings 48 passing therethrough and rotor 46 press-fitted on the crankshaft 30.

The upper surface of main bearing housing 24 is provided with a bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement. An Oldham coupling 68 is also provided positioned between orbiting scroll member 56 and bearing housing 24 and keyed to orbiting scroll member 56 and a non-orbiting scroll member 70 to prevent rotational movement of orbiting scroll member 56.

An oil path in the compressor 10 begins at the oil sump 44. From the oil sump 44, oil is drawn through the oil passage 38, 40 in the crankshaft 30 to lubricate the plurality of bearings (34, 36, 62) as well as the interface between the non-orbiting scroll member 70 and the orbiting scroll member 56. Oil is also used to lubricate the thrust surface between end plate 60 and bearing surface 54. Upon lubricating the bearings and the scroll interface, some of the oil becomes entrained in the compressed gases and exits the compressor 10 at the outlet port 18, while the remaining oil returns back down to the oil sump 44. A centrifugal force pumps the oil through the inner hole 38, 40 of the crankshaft 30, through three (3) openings: a top shaft oil opening 82, a main bearing oil opening 84, and a lower bearing oil opening 86.

A first temperature sensor 88 is located at the bottom of the oil sump 44. A second temperature sensor 90 can be located on the bearing surface 54. The location of the second temperature sensor 90 at a movable part is not limited to the bearing surface; it may be located at another movable part of the compressor 10. For example, the second temperature sensor 90 at a movable part may be located at the drive bearing 62 or the main journal bearing 34. The compressor 10 can further include a third temperature sensor 94 for determining the discharge temperature.

In the embodiment of FIG. 1, the relationship between the oil temperature, as determined by the first temperature sensor 88 of the oil, and the movable part temperature, as determined by the second temperature sensor 90 at a movable part, can be used to determine whether the compressor is operating with an oil level in an acceptable state or an unacceptable state. A lack of lubrication can cause overheating of certain parts of the compressor 10 that can be detected to identify an unacceptable oil level state. It should also be understood, however, that other types of sensors (e.g., optical sensors, infrared sensors, or float-type sensors), or other methods can be used to determine the level of oil and generate or derive a signal indicative of such in a given compressor. Additional modes, such as a warning mode, may also be employed in determining a state of the compressor 10. The resulting state may correspond to a signal indicative of the state of the oil level of the compressor. In particular, the temperature of the thrust plate or other movable parts (as sensed by sensor 90) can increase in case of poor lubrication and therefore provide an indication of low lubrication state. The oil temperature in the oil sump (as sensed by sensor 88) can be used as a reference for thrust plate temperature as the thrust plate temp varies with the running condition. The discharge temperature (as sensed by sensor 94) can be used to verify if the compressor is running stable or if it is in a transient state. The controller can use these various temperature signals to determine if the compressor is operating at a proper lubrication state (green), a low lubrication state (yellow) or an unacceptable lubrication state (red). Although the oil level state is described herein as being determined based upon temperature sensors 88, 90, 94 other known oil level sensing systems, including but not limited to float-type and electrical conductance-type sensors can be used to generate a signal representative of the oil level of each compressor.

Figure 2:
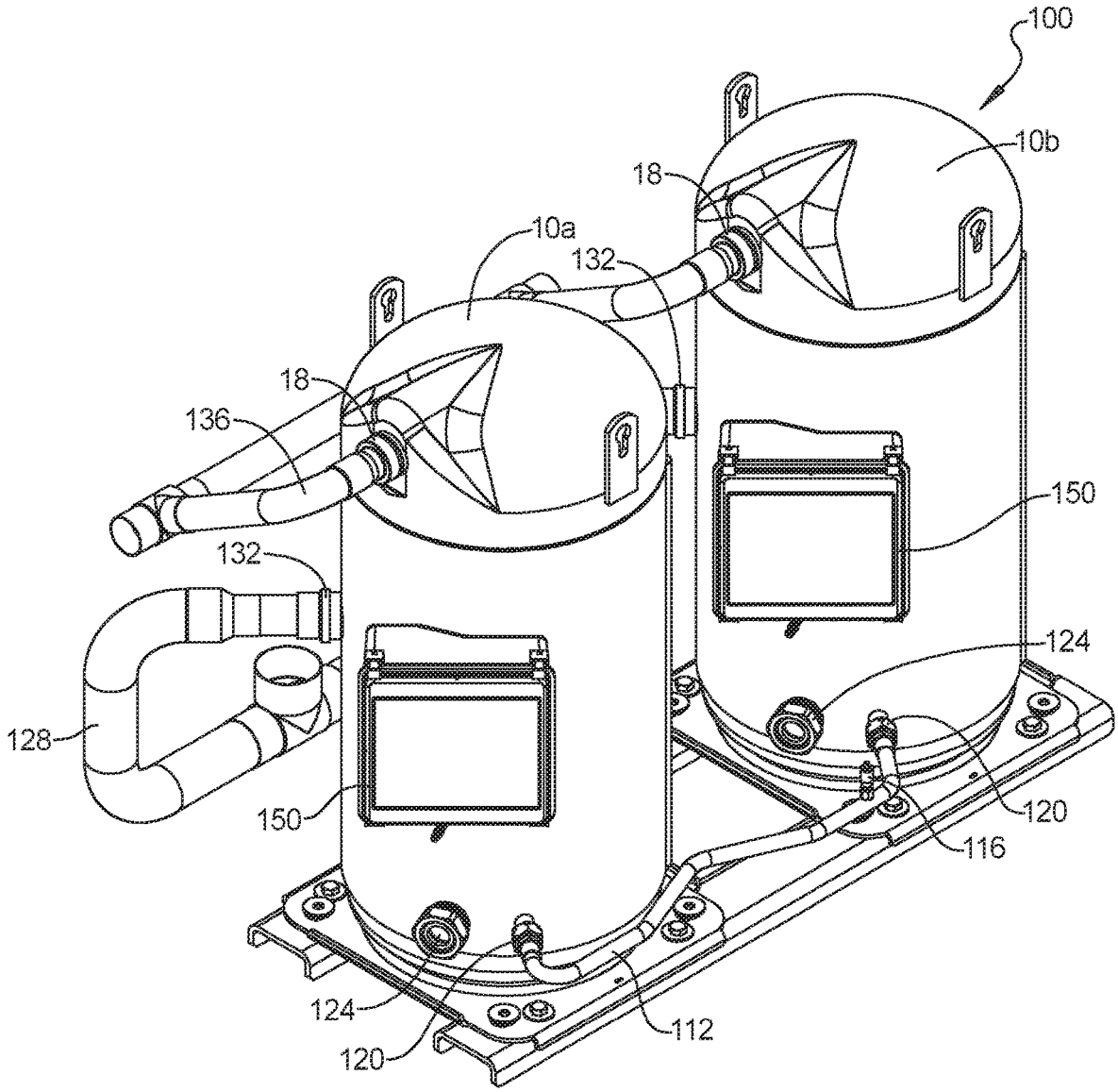
FIG. 2 is a perspective view of a tandem compressor system according to the present disclosure.
Figure 3:
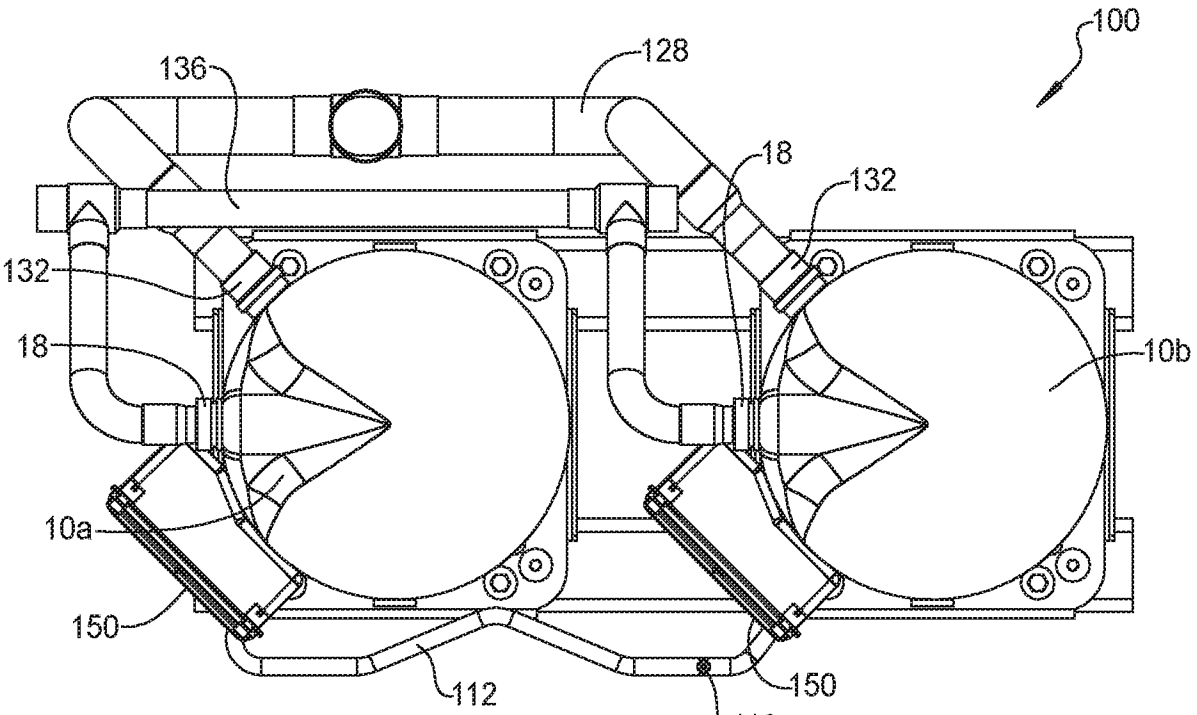
FIG. 3 is a top view of a tandem compressor system according to the present disclosure.

With reference to FIGS. 2 and 3, a tandem compressor system 100 is shown. The tandem compressor system 100 includes a pair of compressors 10*a* and 10*b* that operate either singularly or in combination. Each of these may be a scroll compressor, as illustrated in FIG. 1, however, it should be understood that other compressors may be used while remaining within the scope of the present disclosure. For example, rotary, rotating, orbiting, and reciprocating compressor types may be employed. Moreover, the compressors 10*a* and 10*b* need not be identical with respect to type and capacity.

Returning to FIGS. 2 and 3, the compressors 10*a* and 10*b* each receive refrigerant from a common suction manifold 128. Each compressor, 10*a* and 10*b*, includes a suction gas inlet fitting 132 to connect to the suction manifold 128. The tandem compressor system 100 further includes a bidirectional discharge manifold 136 for discharge of compressed refrigerant. Each compressor, 10*a* and 10*b*, includes a refrigerant discharge outlet port 18 to connect to the bidirectional discharge manifold 136.

An oil equalization line 112 extends between the pairs of compressors 10*a* and 10*b*. Each compressor, 10*a* and 10*b*, includes an oil equalization fitting 120 to connect the oil equalization line 112. The oil equalization line 112 may be a small-diameter tube for transfer of lubricant oil between compressors. A small-diameter tube may have a diameter of 0.625 inch. The oil equalization line 112 includes a valve 116 that may be controlled by an external processor, variable speed drive, or system controller (not shown). It should be understood that valve 116 can be a solenoid valve, proportional valve, or any other type of actuated valve. Each compressor, 10*a* and 10*b*, may further include an oil sight glass 124. The oil equalization line 112 may also have a large diameter, such as 1.375 inches, when it is used for both lubricant oil and refrigerant gas. A system with a large-diameter oil equalization line 112 may further comprise a full flow ball valve (not shown).

Figure 4:
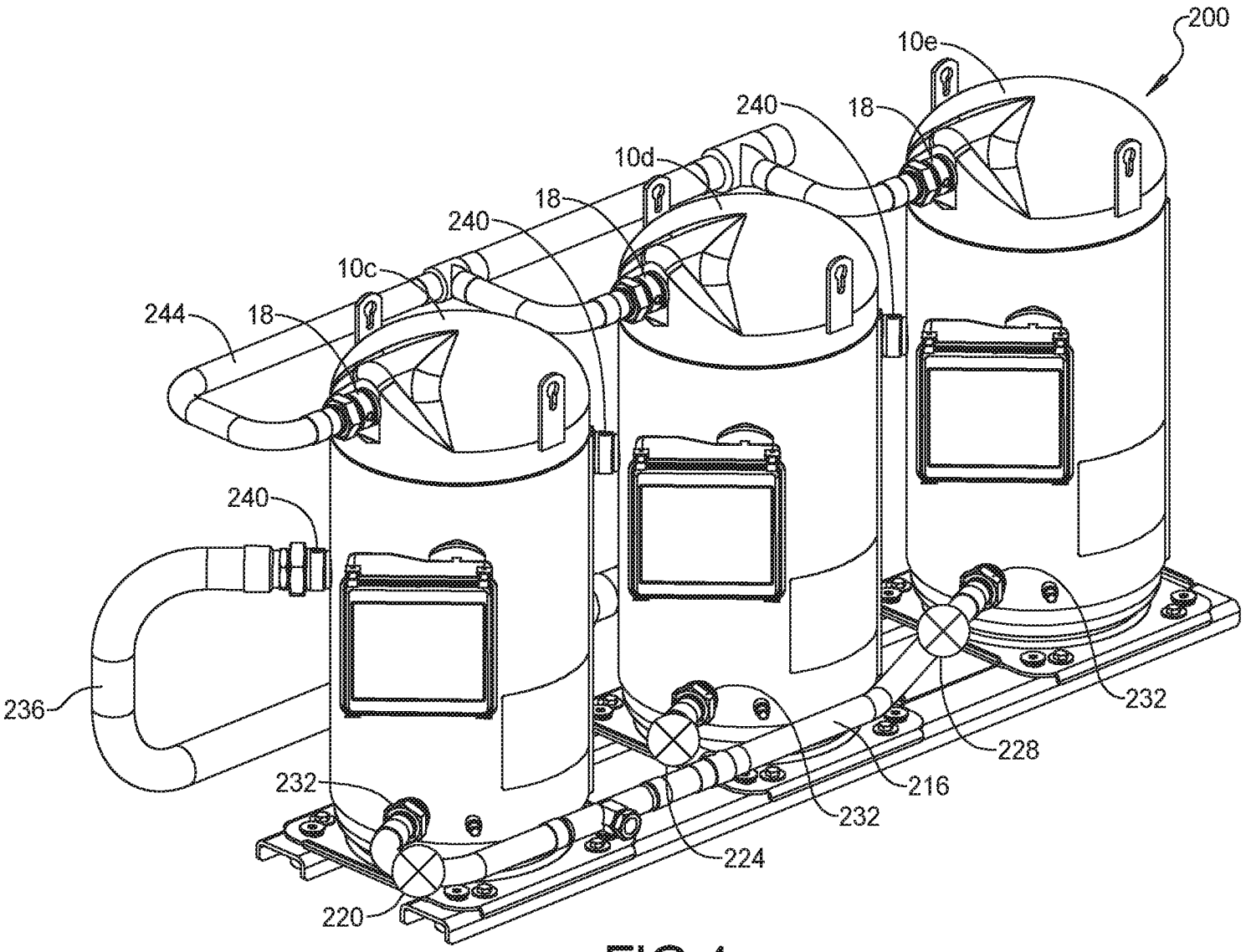
FIG. 4 is a perspective view of a multiple compressor system including three compressors according to the present disclosure.

Referring to FIG. 4, an alternate embodiment of a multiple compressor system 200 is provided. The trio compressor system 200 comprises a set of compressors 10*c*, 10*d*, and 10*e*. Each of the compressors 10*c*, 10*d*, and 10*e* receives refrigerant from a common suction manifold 236. Each of the compressors 10*c*, 10*d*, and 10*e* includes a suction gas inlet fitting 240 to connect to the suction manifold 236. The trio compressor system 200 further includes a bidirectional discharge manifold 244 for discharge of compressed refrigerant. Each of the compressors 10*c*, 10*d*, and 10*e* includes a refrigerant discharge fitting 18 to connect the bidirectional discharge manifold 244.

An oil equalization line 216 extends between the compressors 10*c*, 10*d*, and 10*e*. Each of the compressors 10*c*, 10*d*, and 10*e* includes an oil equalization fitting 232 to connect to the oil equalization line 216. The oil equalization line 216 includes a first solenoid valve 220, located to be capable of isolating the oil of compressor 10*c*. The oil equalization line 216 further includes a second solenoid valve 224, located to be capable of isolating the compressor 10*d*. The oil equalization line 216 further includes a third solenoid valve 228 located to be capable of isolating compressor 10*e*. The solenoid valves 220, 224, 228 can also be any type of proportionally opening and closing valve which open a certain amount based on a signal from the controller. It should also be understood that these valves can be operated in a pulse-width modulation scheme to approximate different amounts of open/close.

While FIG. 4 depicts three compressors, it should be understood other numbers of compressors may be employed while remaining within the scope of the present disclosure. For example, four or five compressors connected in a multiple arrangement may be used.

Figure 5:
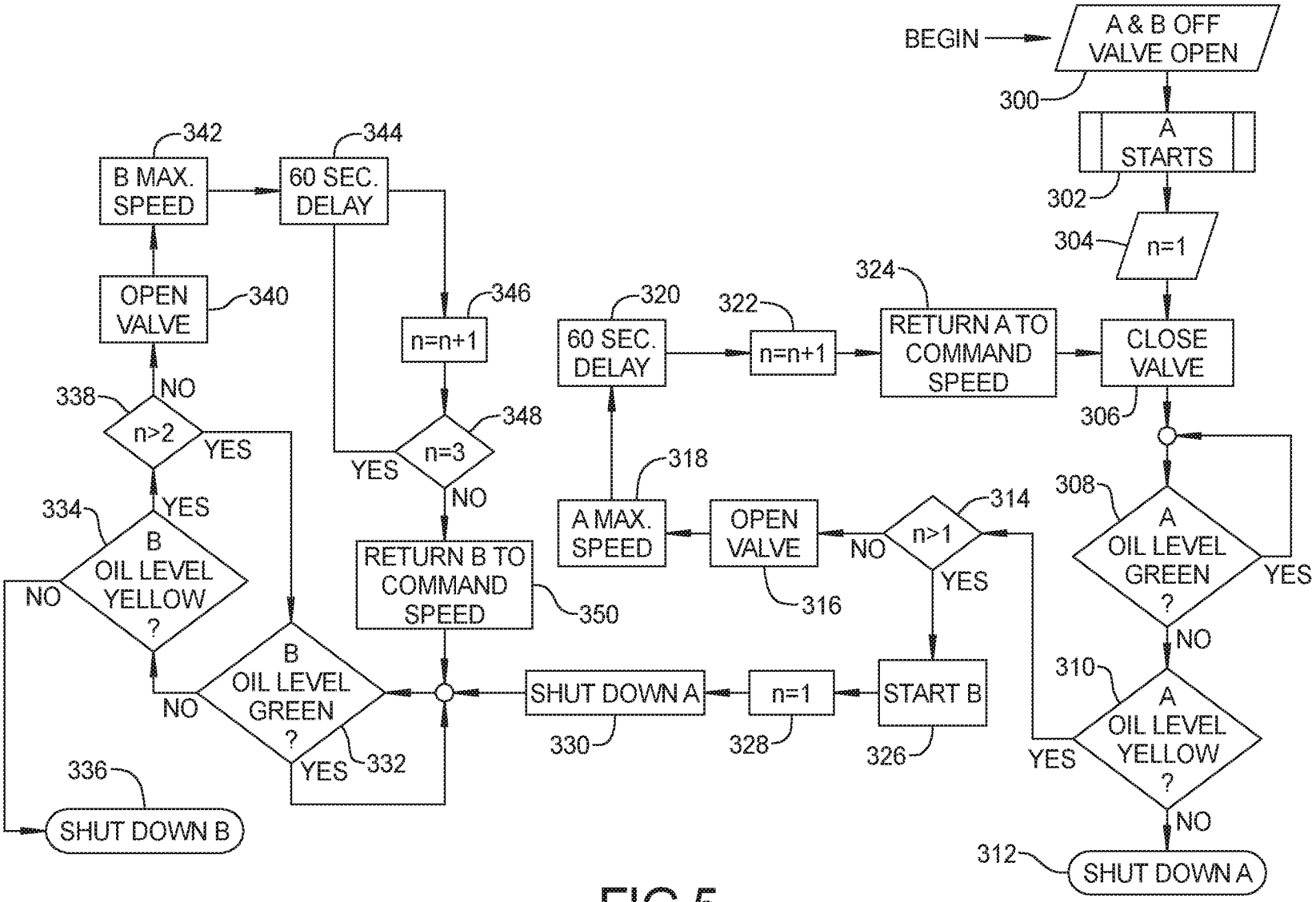
FIG. 5 is a functional block diagram of an example of an oil balancing module for a tandem compressor system operating in single compressor state.
Figure 6A:
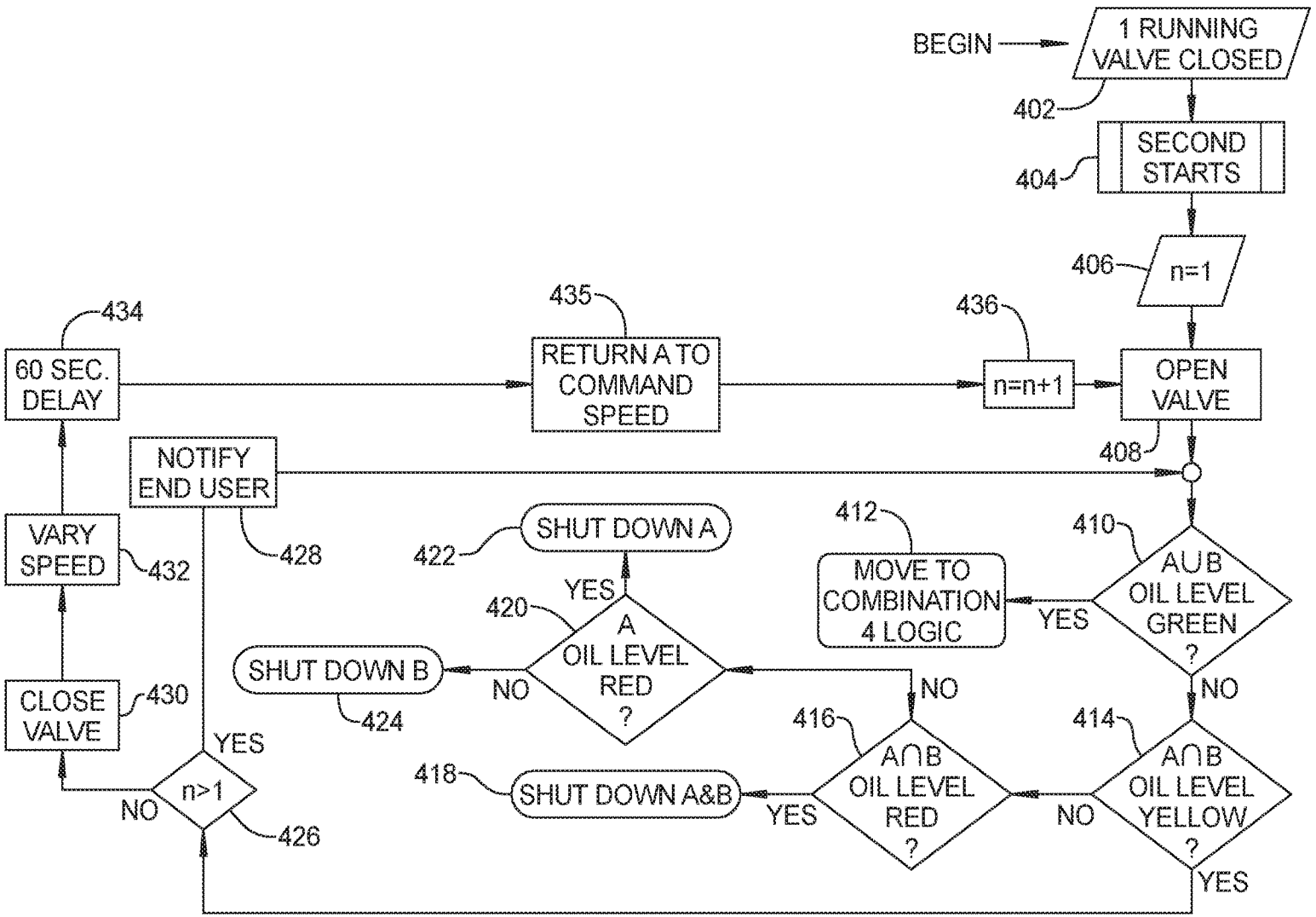
FIGS. 6A and 6B are functional block diagrams of an example of an oil balancing module for a tandem compressor system operating in tandem compressor state.
Figure 6B:
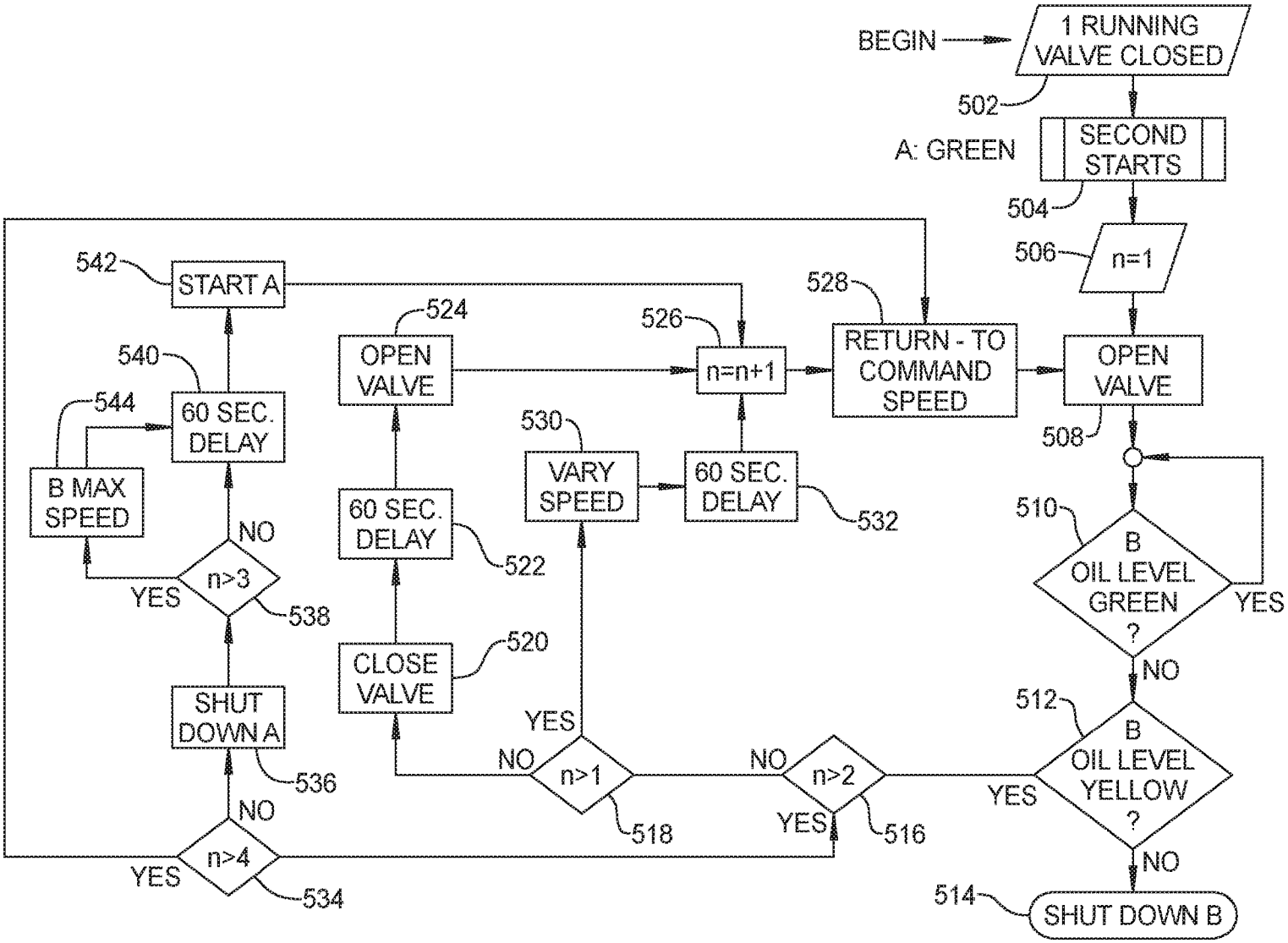

FIGS. 5, 6A, and 6B depict control logic for an oil balancing module that uses a signal corresponding to oil level from each compressor, and applies corrective action in response to an oil imbalance. The corrective action comprises of sending control signals to operate at least one of the compressors, or a valve in a way that eliminates the oil imbalance. Each compressor 10*a* and 10*b* can include a control unit 150 that can be used individually or in combination to control the tandem compressors 10*a* and 10*b* as well as the solenoid valve 116 in the manner described herein. Alternatively, a separate controller can be used for carrying out the oil balancing control.

Referring to FIG. 5, a flowchart depicting example control logic for running an oil control module for a tandem compressor system comprising of a first compressor and a second compressor, in single compressor state is presented. The system employs an oil sensing module that determines which of three states, "red," "yellow," or "green," that a compressor is running in based on its oil level. The threshold oil levels for each state are based on predetermined oil level values. It should be noted that any number of oil level states can be used while remaining within the scope of the present disclosure. For example, five states or continuous level sensing may be employed. Also, the use of just two oil level states such as "OK" and "Not OK" can be used in a less complex control scheme.

The single compressor state control logic in FIG. 5 can be summarized as follows. Control responds to an oil level warning from a signal by first opening a first solenoid valve and ramping up the speed of the first compressor. Ramping up the speed of the first compressor increases suction, thereby drawing lubricant oil into the first compressor from the second compressor. The first compressor is then returned to a command speed, the first solenoid valve is closed, and operation switches to the second compressor if the lubrication issue has not been resolved. It should be noted that the steps of ramping compressor speed and returning to command speed are optional, and may be performed when a drive is available. It should also be noted that when a variable speed compressor is included in the system, the control may send a signal to either increase or decrease the speed of the compressor to a rate that is either above or below the rotational speed of the other compressor in the system. When the oil level is low in the variable speed compressor, the rotational speed of the variable speed compressor is increased to draw oil into that compressor. When the oil level is low in the other compressor, the rotational speed of the variable speed compressor is reduced to a level below that of the other compressor to allow the other compressor to draw oil into it. The control logic of FIG. 5 is described in greater detail below.

Control begins at 300, when the first compressor and the second compressor are both off and the first solenoid valve is open. Control continues at 302, where the first compressor starts. At 304, a count is set to one (1). Control continues at 306, where the first solenoid valve is placed in a default closed valve position.

At 308, an oil sensing module determines whether the oil level in the first compressor is "green." If the oil level is "green" (i.e. within a preferred level) at 308, then control remains at 308. If, at any time, the loop at 308 continues for a predetermined duration, which may be five (5) minutes, then the count is set to one (1). Alternatively, if the oil level at 308 is not "green," then control moves to 310, where the oil sensing module determines whether the oil level in the first compressor is "yellow." If the oil level is not "yellow" (i.e. within a caution level) at 310, then it is necessarily "red" (unacceptable level) and the first compressor is shut down at 312.

Returning to 310, if the oil level of the first compressor is "yellow," control moves to 314. If the count is not greater than one (1) at 314, then the first solenoid valve is opened at 316. At 318, the first compressor is optionally run at its maximum speed. At 320, control waits for a predetermined delay, which may be sixty (60) seconds. The predetermined delay may be modified. Control then moves to 322, where the count is increased by one (1). At 324, the first compressor is optionally returned to a predetermined command speed. Control returns to 306.

Returning to 314, if the count is greater than one (1), then a second compressor is started at 326. Control moves to 328 where the count is set to one (1). The first compressor is shut down at 330. At 332, the oil sensing module determines whether the oil level in the second compressor is "green." If the oil level in the second compressor is "green," then control remains at 332. If, at any time, the loop at 332 continues for a predetermined duration, which may be five (5) minutes, then the count is set to one (1). If the oil level is not "green," then control moves to 334. At 334, the oil sensing module determines whether the oil level is "yellow." If the oil level is not yellow, then it is necessarily "red" and the second compressor is shut down at 336.

Returning to 334, if the oil level is "yellow," control moves to 338. At 338, if the count is not greater than two (2), then control moves to 340, where the first solenoid valve is opened. Next, at 342, the second compressor is optionally run at its maximum speed. Control moves to 344, where control waits for a predetermined delay, which may be sixty (60) seconds. Control then moves to 346, where the count is increased by one (1). Next, at 348, if the count is equal to three (3), then control returns to 344. Alternatively, if the count is not equal to three (3), then control moves to 350, where the second compressor is optionally returned to a predetermined command speed. Control is returned to 332.

Referring to FIG. 6A, a flowchart depicting example control logic for running a tandem compressor system comprising a first compressor and a second compressor, in tandem compressor state is presented. More specifically, FIG. 6A depicts logic for when both compressors are not running in the "green" state. The control logic of FIG. 6A can be summarized as follows. Control responds to an oil level warning on both compressors by closing the first solenoid valve and varying the speed of one or both of the first compressor and the second compressor. Next, the first compressor and the second compressor are returned to a command speed, and then the first solenoid valve is opened. The end user may be notified. The control logic of FIG. 6A is described in greater detail below.

Control begins at 402, where the first compressor is running and the first solenoid valve is closed. Control continues at 404 where the second compressor is started. At 406, a count is set to one (1). Control continues at 408, where the first solenoid valve is placed in a default opened valve position.

At 410, control determines whether the state of either the first compressor or the second compressor is "green." If at least one of the state of the first compressor or the second compressor is "green," then control is transferred to the logic depicted in FIG. 6B at 412. If neither the first compressor nor the second compressor is in the "green" state, then control moves to 414. At 414, control determines whether the state of both the first compressor and the second compressor is "yellow." If 414 is false, then control moves to 416. At 416, control determines whether the state of both the first compressor and the second compressor is "red." If 416 is true, then both of the first compressor and the second compressor are shut down at 418.

Returning to 416, if control determines that the first compressor and the second compressor are not both in the "red" state, then control moves to 420. At 420, control determines whether the first compressor is in the "red" state. If 420 is true, then the first compressor is shut down at 422. If 420 is false, then the second compressor is shut down at 424. In other words, if both compressors are not in a "red" state at 416, then one of the compressors is necessarily in a "red" state. Control at 420-424 determines which compressor is in a "red" state and shuts that compressor down.

Returning to 414, if both the first compressor and the second compressor are in the "yellow" state, control moves to 426. At 426, control determines whether the count is greater than one (1). If the count is greater than one (1) at 426, control moves to 428, where the end user is notified, then control returns to 410. Notification of the end user at 428 may be in the form of a blinking light or a text alert, for example. User notification may be useful in alerting a user as to the possibility of a leak. Returning to 426, if the count is not greater than one (1), then the first solenoid valve is closed at 430. Control moves to 432, where the speed of the first compressor or the second compressor may be increased to maximum speed. It should be understood that if only one of the compressors is variable speed, the speed of that compressor can be reduced to a value less than the rotational speed of the other compressor so that the other compressor can draw oil and reduce the imbalance. At 434, control waits for a predetermined delay, which may be sixty (60) seconds and the control returns the first and second compressors to command speed 435. Next, at 436, the count is increased by one (1). Control returns to 408.

Referring to FIG. 6B, a flowchart depicting example control logic for running a tandem compressor system comprising a first compressor and a second compressor, in tandem compressor state is presented. More specifically, FIG. 6B depicts logic for when at least one of the first compressor or the second compressor is running in the "green" state. The control logic of FIG. 6B can be summarized as follows. Control responds to an oil level warning on the second compressor by closing the first solenoid valve. The first solenoid valve is then opened and the speed of the second compressor is varied. The second compressor is returned to a command speed. One or both of the first compressor and the second compressor may be shut down. The control logic of FIG. 6B is described in greater detail below.

Control begins at 502, where the first compressor is running and the first solenoid valve is closed. At 504, the second compressor starts. Control continues at 506, where a count is set to one (1). Control continues at 508, where the first solenoid valve is moved to the opened default valve position. The state of the first compressor 10*a* is "green."

At 510, control determines whether the state of the second compressor is "green." If true, then control returns to 510. If, at any time, this loop continues for more than a predetermined duration, which may be five minutes, then the count is set to one (1). If 510 is false, then control moves to 512. At 512, control determines whether the state of the second compressor is "yellow." If 512 is false, then the state of the second compressor is necessarily "red," and the second compressor is shut down at 514. If 512 is true, then control moves to 516.

At 516, if the count is not greater than two (2), then control moves to 518. At 518, if the count is not greater than one (1), then the first solenoid valve is closed at 520. Control moves to 522, where control waits for a predetermined delay, which may be sixty (60) seconds. At 524, the first solenoid valve is opened. Control moves to 526, where the count is increased by one (1). At 528, control is optionally returned to a command speed, and then control returns to 510.

Returning to 518, if the count is greater than one (1), then the speed of the first or second compressor is optionally varied at 530. Control moves to 532, where control waits for a predetermined delay, which may be 60 seconds. At 526, the count is increased by one (1). At 528, the first and second compressors are optionally returned to a predetermined command speed. Control then returns to 510.

Returning to 516, if the count is greater than two, control moves to 534. At 534, control determines if the count is greater than four (4). If 534 is false, then the first compressor is shut down at 536. At 538, control determines whether the count is greater than three (3). If 538 is false, then control waits for a predetermined delay at 540, which may be 60 seconds. At 540, the first compressor is started. Control then returns to 526.

Returning to 538, if the count is greater than three (3), then the second compressor is optionally set to its maximum speed at 544. Control then moves to 540 where it waits for a predetermined delay, which may be sixty (60) seconds. The first compressor is started at 542, and then control returns to 526.

Returning to 534, if the count is greater than four (4), then control moves to 528, where the first and second compressors are optionally returned to a command speed. If this loop continues for more than a predetermined duration, which may be two (2) hours, then the count is set to one (1). Control returns to 510.

The oil balancing system of the present disclosure may include a self-learning module. The self-learning module uses the amount of time spent in each state for each compressor to alter the corrective action in the oil balancing module. The system keeps record of previous red/yellow/green conditions and uses the record to alter the logic for operation. For example, the oil balancing module may alter a predetermined time delay based on how long it took for a compressor to return to an acceptable "green" state. This amount of time is used the next time an issue is detected. Further, if warnings occur at a predictable interval, corrective action could be taken preemptively through pulse width modulation of the solenoid valve. Through pulse width modulation of the solenoid valve, oil control can be used to better match oil transfer with incoming oil to the suction manifold as it returns from the system. Through the learning mode, future imbalanced oil levels could be prevented all together in certain scenarios. For example, if one of the first and second compressors repetitively enters the warning mode after a uniform amount of time, the oil balancing module can initiate a corrective action, such as increasing the speed of the first or second compressor or operating the valve before the next uniform amount of time to preempt the first or second compressor entering the warning mode.

The oil balancing system may further include a quarantine module configured to isolate a compressor that is operating in an unacceptable or "red" state. Isolation is achieved through operation of the first solenoid valve and shutting down the quarantined compressor. The oil balancing system may also contain a fault count module configured to increment a fault count when a fault signal is detected. The oil sensing logic can lock out the compressor after too many "red" conditions have been observed. A benefit of the quarantine module is to prevent cross-contamination of debris contained in a compressor due to internal damage, such as a bearing nonconformance or particles created by the wearing of moving parts. When a compressor is quarantined, the system can enter a "limp" mode wherein the system runs at a reduced capacity because the quarantined compressor is no longer operating. In this situation, the system is still able to provide some cooling (or heating) based on the capacity of the non-quarantined compressors.

The oil balancing system may also include a leak detection module configured to use the oil level signal of both compressors to determine whether a leak is present. In particular, oil sensing logic can detect low oil levels after an adequate amount of time has passed to rule out incorrect system commissioning. After valve logic is implemented for corrective action, the oil sensing logic can still detect low oil levels so that an oil leak condition can be determined. By increasing the speed of the compressor with a low oil level, the flow rate through the system also increases, which in turn will move oil that may have pooled in a location within the system back in to the compressor. If the level of oil in the affected compressor does not thereafter increase, an oil leak is likely. In addition, a discharge temperature map, built into the logic, can be used to differentiate between an oil only leak and a combined gas and oil leak. The oil detection module can determine the theoretical discharge temperature from the map based on the system conditions. If the actual discharge temperature differs by a predetermined percentage from the theoretical value obtained from the discharge temperature map, the system can conclude that a leak may be present. Accordingly, the leak detection module may use the discharge temperature of each compressor to assist a service technician in determining the probable location of the leak. If the actual discharge temperature is approximately the same as the theoretical discharge temperature obtained from the map, the system is leaking oil only and the leak will be located in the compressor sump. If the actual discharge temperature is higher than the theoretical discharge temperature obtained from the map (i.e., greater than 10%), the system is leaking both oil and refrigerant from a location within the system, other than the sump.

A hierarchy of control logic allows co-existence of the various control modules presented in this description. The priority of algorithms in the oil balancing system may be as follows: (1) oil sensing; (2) compressor quarantine; (3) control logic for running a multiple compressor system (as in FIG. 6A); then all other control algorithms.

The system of the present invention provides an alternative method of oil balancing in a tandem compressor system in order to reduce oil management risks, maximize compressor uptime and avoid nuisance trips. The present disclosure reduces or eliminates the need for flow washers in tandem compressor systems and therefore results in a reduction in parts. The system reduces overall cost of some tandem models by switching from a two phase tube line to an oil equalization line with a ball valve. The system detects low oil charges associated with incorrect commissioning or oil leaking from the system by still detecting low oil levels in the compressors after corrective action has been taken. The solenoid valve can be used to isolate a nonconforming compressor from the other compressor(s) to reduce cross-contamination. The system improves tandem compressor reliability and maximizes tandem compressor run time.

The present disclosure provides a tandem compressor system with a solenoid valve, on an oil equalization line that is controlled by an external processor. The external processor provides the ability to diagnose oil imbalance as well as causes. A prescribed set of corrective actions can be taken to improve oil balance including compressor cycling, changing compressor speed and/or capacity modulation, and opening/closing the solenoid valve utilizing steady-state and/or pulse width modulation. The system provides the ability to verify the corrective actions have improved the oil balance and allows for the sending of alarms to communicate common faults and recommended actions to system controllers. The system provides the ability to switch to "limp" mode when oil imbalance cannot be cleared to maximize delivery of some capacity rather than risking compressor malfunction. Self-learning capabilities are provided to optimize the solenoid valve positions, pulse width modulation levels and timing. The system provides the ability to use pulse width modulation to channel a proper amount of oil to the compressors in the event of uneven pressure balance and/or oil return. The system is compatible with various oil sensing systems. The system also provides the ability to quarantine with the equalization line valve to prevent cross-contamination of oil sumps. The system enables leak detection by oil sensing and prescribed corrective actions that can utilize a map to declare the nature of a leak of the oil and/or refrigerant.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An oil balancing system for a multiple compressor system, the oil balancing system comprising:

a first compressor;

a second compressor;

an oil equalization line disposed between the first compressor and the second compressor;

a first valve in the oil equalization line;

an oil level detection system for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and applies corrective action, whereby the corrective action comprises sending control signals to change the operating speed of one of the first compressor and the second compressor, and the corrective action further comprises operating the first valve in a way that eliminates or reduces the oil imbalance;

wherein the oil level detecting system uses the first signal to determine whether the first compressor operates in an acceptable mode or an unacceptable mode based on a first predetermined unacceptable value for the first signal, and uses the second signal to determine whether the second compressor operates in the acceptable mode or the unacceptable mode based on a second predetermined unacceptable value for the second signal;

wherein the oil level detecting system uses the first signal to determine whether the first compressor operates in a warning mode based on a first predetermined warning value for the first signal, and uses the second signal to determine whether the second compressor operates in the warning mode based on a second predetermined warning value for the second signal; and a self-learning module configured to create a record of time spent in an acceptable mode, warning mode, and unacceptable mode for each of the first compressor and the second compressor, wherein the self-learning module alters the corrective action of the oil balancing module based on the record.

2. The oil balancing system of claim 1, wherein the oil balancing module further uses the first signal and the second signal to verify that the corrective action has eliminated or reduced the oil imbalance.

3. The oil balancing system of claim 2, wherein after the oil imbalance is eliminated, the affected compressor returns to a predetermined command speed.

4. The oil balancing system of claim 1, wherein in the warning mode, the oil balancing module opens the first valve and changes the speed of one of the first or second compressors for a predetermined amount of time.

5. An oil balancing system for a multiple compressor system, the oil balancing system comprising:

a first compressor;

a second compressor;

an oil equalization line disposed between the first compressor and the second compressor;

a first valve in the oil equalization line;

an oil level detection system for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and applies corrective action, whereby the corrective action comprises sending control signals to change the operating speed of one of the first compressor and the second compressor, and the corrective action further comprises operating the first valve in a way that eliminates or reduces the oil imbalance;

wherein the oil level detecting system uses the first signal to determine whether the first compressor operates in an acceptable mode or an unacceptable mode based on a first predetermined unacceptable value for the first signal, and uses the second signal to determine whether the second compressor operates in the acceptable mode or the unacceptable mode based on a second predetermined unacceptable value for the second signal;

wherein a first fault signal is generated when the first compressor operates in the unacceptable mode for a first predetermined amount of time and a second fault signal is generated when the second compressor operates in the unacceptable mode for the first predetermined amount of time;

wherein the oil balancing system further comprises:

a fault count module configured to increment a first fault count when a first fault signal is detected and to increment a second fault count when a second fault signal is detected; and a quarantine module configured to close the first valve when the first fault count or the second fault count exceeds a predetermined quarantine set point.

6. The oil balancing system of claim 5, wherein after a predetermined number of first fault signals are generated, the oil balancing module initiates operation of the second compressor.

7. The oil balancing system of claim 5, wherein the quarantine module is further configured to shut down the first compressor when the first fault count exceeds the quarantine set point and to shut down the second compressor when the second fault count exceeds the quarantine set point.

8. An oil balancing system for a multiple compressor system, the oil balancing system comprising:

a first compressor;

a second compressor;

an oil equalization line disposed between the first compressor and the second compressor;

a first valve in the oil equalization line;

an oil level detection system for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and applies corrective action, whereby the corrective action comprises sending control signals to change the operating speed of one of the first compressor and the second compressor, and the corrective action further comprises operating the first valve in a way that eliminates or reduces the oil imbalance;

wherein the oil level detecting system uses the first signal to determine whether the first compressor operates in an acceptable mode or an unacceptable mode based on a first predetermined unacceptable value for the first signal, and uses the second signal to determine whether the second compressor operates in the acceptable mode or the unacceptable mode based on a second predetermined unacceptable value for the second signal;

wherein a first fault signal is generated when the first compressor operates in the unacceptable mode for a first predetermined amount of time and a second fault signal is generated when the second compressor operates in the unacceptable mode for the first predetermined amount of time;

wherein the oil balancing system further comprises:

a fault count module configured to increment a first fault count when a first fault signal is detected and to increment a second fault count when a second fault signal is detected; and wherein after a second predetermined amount of time and a predetermined fault count, the oil balancing module notifies the user that there is a possible leak.

9. An oil balancing system for a multiple compressor system, the oil balancing system comprising:

a first compressor;

a second compressor;

an oil equalization line disposed between the first compressor and the second compressor;

a first valve in the oil equalization line;

an oil level detection system for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and applies corrective action, whereby the corrective action comprises sending control signals to change the operating speed of one of the first compressor and the second compressor, and the corrective action further comprises operating the first valve in a way that eliminates or reduces the oil imbalance;

further comprising a leak detection module, wherein the leak detection module uses the first signal and the second signal to determine whether an oil leak is present, wherein the leak detection module uses a first discharge temperature of the first compressor and a second discharge temperature of a second compressor to determine if there is a refrigerant leak, wherein the first discharge temperature and second discharge temperature are compared to a first theoretical discharge temperature and a second theoretical discharge temperature, respectively, found on a look-up table, wherein the leak detection module notifies the user of potential locations of the leak based upon whether the first or second discharge temperatures are higher than the first and second theoretical discharge temperature.

10. An oil balancing system for a multiple compressor system, the oil balancing system comprising:

a first compressor;

a second compressor;

an oil equalization line disposed between the first compressor and the second compressor;

a first valve in the oil equalization line;

an oil level detection system for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and applies corrective action, whereby the corrective action comprises sending control signals to change the operating speed of one of the first compressor and the second compressor, and the corrective action further comprises operating the first valve in a way that eliminates or reduces the oil imbalance;

a third compressor, wherein the oil equalization line further extends to the third compressor and whereby the first valve is disposed at a location such that it is capable of isolating the first compressor from the second compressor and the third compressor;

a second valve on the oil equalization line at a location such that it is capable of isolating the second compressor from the first compressor and the third compressor;

a third valve on the oil equalization line at a location such that it is capable of isolating the third compressor from the first compressor and the second compressor; and the oil level detection system generating a third signal corresponding to a third oil level in the third compressor, wherein the oil balancing module further uses the third signal to diagnose an oil imbalance, and applies corrective action, whereby the corrective action may further comprise sending control signals to operate at least one of the third compressor, the second valve, or the third valve, wherein a priority of algorithms in the oil balancing module is as follows: (1) oil level detection in the first, second and third compressors; (2) compressor quarantine when it is determined that an oil level is below a predetermined oil level, wherein quarantine is performed by shutting down the quarantined compressor and isolating the quarantined compressor by closing one of the first, second and third valves; (3) control logic for running a multiple compressor system; then all other control algorithms.

11. An oil balancing system for a multiple compressor system, the oil balancing system comprising:

a first compressor;

a second compressor;

an oil equalization line disposed between the first compressor and the second compressor;

a first valve on the oil equalization line;

an oil level detection system associated with said first and/or second compressors for generating a first signal corresponding to a first oil level in the first compressor and a second signal corresponding to a second oil level in the second compressor; and an oil balancing module that uses the first signal and the second signal to diagnose an oil imbalance between the first compressor and the second compressor, and the oil balancing module includes a self-learning module that applies preemptive corrective action to prevent future imbalanced oil levels, whereby the preemptive corrective action comprises operating at least one of the first and second compressors and the first valve in a way that can closely match an oil transfer between the first and second compressors in order to preempt one of the first or second compressors entering a low oil condition.

* * * * *